US007321653B2

(12) United States Patent
Hockersmith et al.

(10) Patent No.: US 7,321,653 B2
(45) Date of Patent: Jan. 22, 2008

(54) X-RAY TARGET ASSEMBLY FOR HIGH SPEED ANODE OPERATION

(75) Inventors: Ron K. Hockersmith, Waukesha, WI (US); Michael Scott Hebert, Muskego, WI (US)

(73) Assignee: General Electric Co., Schenectady, NY (US)

( * ) Notice: Subject to any disclaimer, the term of this patent is extended or adjusted under 35 U.S.C. 154(b) by 52 days.

(21) Appl. No.: 11/161,778

(22) Filed: Aug. 16, 2005

(65) Prior Publication Data

US 2007/0041504 A1 Feb. 22, 2007

(51) Int. Cl.
*H01J 35/10* (2006.01)

(52) U.S. Cl. ..... 378/144; 378/125; 378/143

(58) Field of Classification Search ..... 378/119, 378/121, 122, 125, 143, 144
See application file for complete search history.

(56) References Cited

U.S. PATENT DOCUMENTS

| | | | | |
|---|---|---|---|---|
| 3,795,832 | A * | 3/1974 | Holland | 378/127 |
| 3,900,751 | A * | 8/1975 | Holland et al. | 378/125 |
| 4,276,493 | A * | 6/1981 | Srinivasa et al. | 378/144 |
| 6,925,152 | B2 * | 8/2005 | Steinlage et al. | 378/144 |
| 6,947,524 | B2 * | 9/2005 | Steinlage et al. | 378/144 |

* cited by examiner

*Primary Examiner*—Jurie Yun

(57) ABSTRACT

An x-ray target assembly is provided comprising a center hub element affixed to a drive shaft and an outer disc including a plurality of tab extensions removably engaging the periphery of the center hub element. A target element is mounted on an upper outer disc surface.

14 Claims, 2 Drawing Sheets

X-RAY TARGET ASSEMBLY FOR HIGH SPEED ANODE OPERATION

TECHNICAL FIELD

The present invention relates generally to an x-ray target assembly and more particularly to an x-ray target assembly with separate hub and disc elements.

BACKGROUND OF THE INVENTION

Modern medical imaging assemblies have increased in complexity and capabilities. These increases often result in an increase in power requirements and associated wear on such assemblies. Such is the case with x-ray tube assemblies. Increases in power requirements of the imaging assembly can result in increases in the required rotational speed of the x-ray target assembly in order to prevent overheating and damage thereto. These increased rotational speeds may result in high hub stresses that exceed present design criteria. The hub is the center portion of a target assembly in communication with the drive shaft.

In addition to the additional stresses associated with the increase in power requirements, the target assembly itself will suffer an increase in wear and thermal damage. These increases stressors are well known to result in damage to the impact regions of the target element. In addition, the thermal energy may translate through the target assembly to enter the hub portion. The increase in thermal energy in combination with the increased stresses due to increased rotational speeds may result in undesirable wear and damage to the hub element.

In any design for an x-ray target assembly it is likely that the target element or portions thereof will suffer damaged during prolonged usage. This is simply a preordained result of the target element being impacted by an electron beam to facilitate the generating of x-rays. Yet when wear or damage becomes too great, existing designs require complete replacement. Disassembly and repair is not contemplated by existing designs and may be impractical based on design configurations and associated costs. Since such wear and damage may only be minimized, a design that introduced the potential for worn or damaged portions of the target element to be replaced would be beneficial. In addition, where repair is still not cost effective, a design that allowed reuse of at least a portion of the target assembly would provide desirable cost benefits.

It would, therefore, be highly desirable to have an x-ray tube target assembly that allows for simplified replacement of worn or damaged portions of the target element. It would also be highly beneficial to have an x-ray tube target assembly that was capable of withstanding the high rotational speeds and increased thermal requirements of modern anode performance.

SUMMARY OF THE INVENTION

An x-ray target assembly is provided comprising a center hub element affixed to a drive shaft and an outer disc including a plurality of tab extensions removably engaging the periphery of the center hub element. A target element is mounted on an upper outer disc surface.

Other features of the present invention will become apparent when viewed in light of the detailed description of the preferred embodiment when taken in conjunction with the attached drawings and appended claims.

DESCRIPTION OF THE PREFERRED EMBODIMENT(S)

Figure 1:
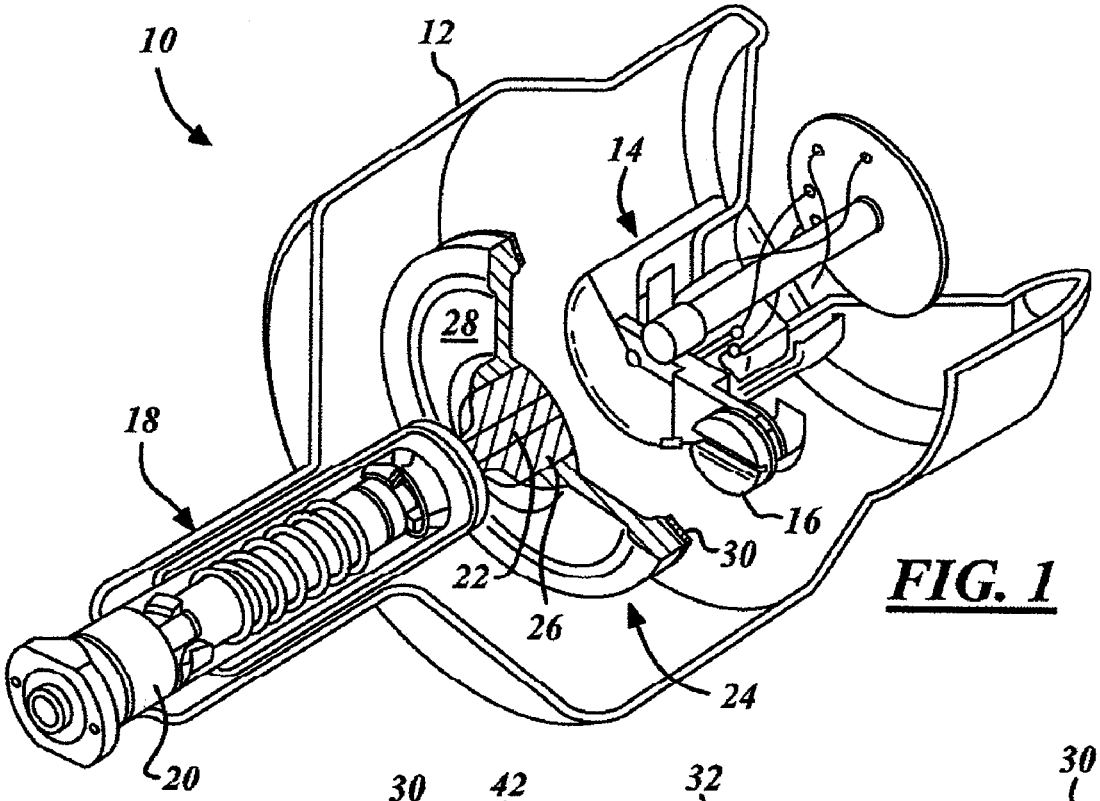
FIG. 1 is an illustration of an x-ray tube assembly in accordance with the present invention.
Figure 2:
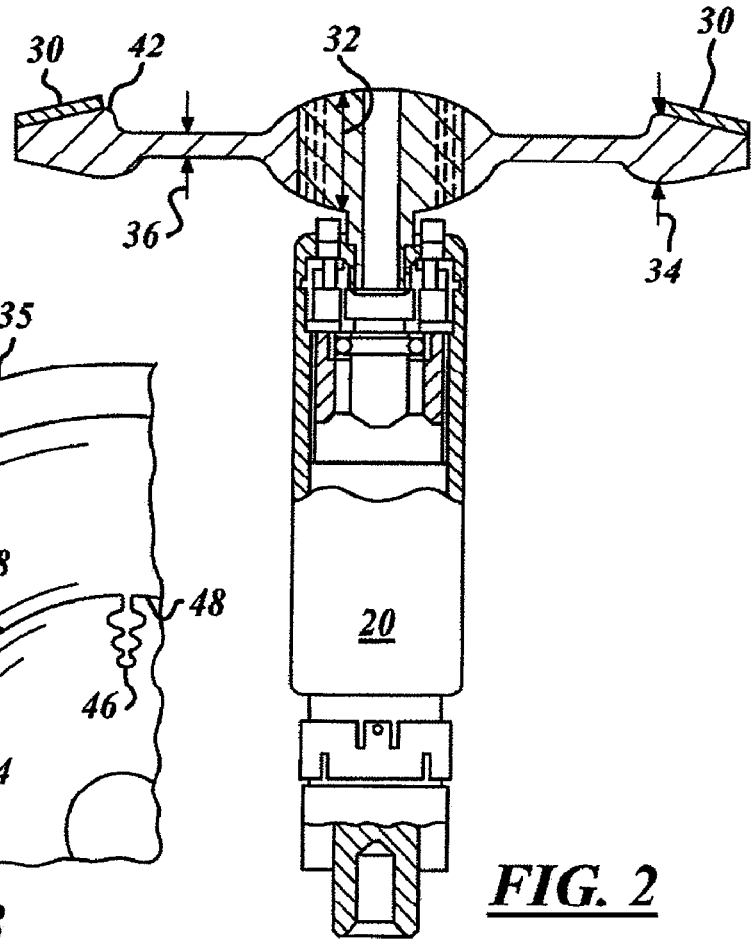
FIG. 2 is a cross-sectional illustration of an x-ray tube target assembly shown in FIG. 1.

Referring now to FIG. 1, which is an illustration of an x-ray tube assembly 10 in accordance with the present invention. The assembly 10 includes a tube casing 12. A variety of tube casings 12 are contemplated by the present invention. Within the tube casing 12 includes a cathode assembly 14 wherein electrons are gathered and discharged through an cathode discharge cup 16 towards an anode assembly 18. The anode assembly 18 is comprised of an anode drive assembly 20 rotating an anode drive shaft 22 which in turn rotates an x-ray tube target assembly 24. As is well known in x-ray tube art, the electrons generated by the cathode assembly 14 impact the x-ray tube target assembly 24 and result in the production of gamma or x-rays.

The impact of electrons on the x-ray tube target assembly 24 generates considerable heat and considerable wear. The present invention contemplates such stressors by forming the x-ray tube target assembly 24 as a center hub element 26 and an outer disc 28. A target element 30 is mounted to the outer disc 28. The outer disc 28 is removably mounted to the center hub element 26 such that if the target element 30 experiences undesirable levels of wear or damage, the outer disc 28 may be replaced while the hub element 26 remains. In addition to replacement, the present design allows to cost savings through reuse of non-damaged portions of the target assembly 24 in new assemblies. Molybdenum, used in target assemblies 24, is expensive and the present invention allows its reuse to provide beneficial cost savings. In addition, the hub element 26 may be optimized to withstand the stresses transmitted to it by the anode drive assembly 20, while the outer disc 28 may be optimized to withstand the thermal energy associated with electron bombardment.

In one particular embodiment, the hub element 26 has a hub cross-sectional width 32 that is increased to reduce stresses due to centrifical loading transferred from the anode drive shaft 22. In addition, the outer disc 28 is preferably comprised of an outer disc cross-sectional width 34 located at the outer perimeter 35 of the outer disc 28 and an inner disc cross-sectional width 36 located at the inner perimeter 38 of the outer disc 28. The inner disc cross-sectional width 36 is preferably smaller than the outer disc cross-sectional width 34 to prevent thermal transfer from the target element 30 to the hub element 26. A taper may be formed in the transition between the inner disc cross-sectional width 36 and the hub cross-sectional width 32 to further reduce stresses. The target element 30 is preferably mounted to an upper outer disc surface 42 of the outer disc 28.

Figure 3:
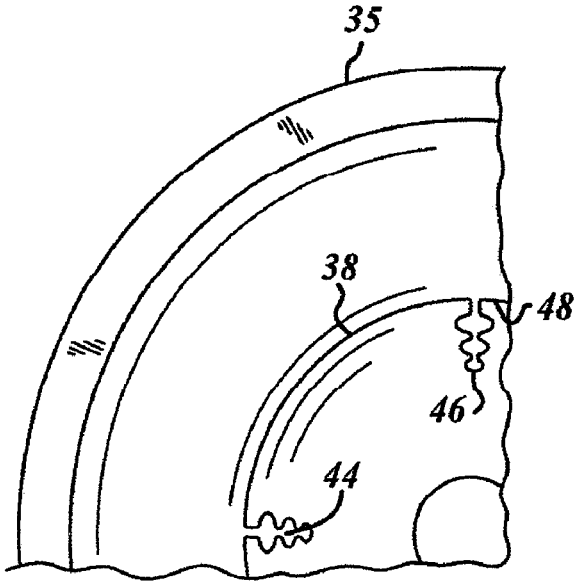
FIG. 3 is a detail illustration of the x-ray tube target assembly shown in FIG. 2.
Figure 4:
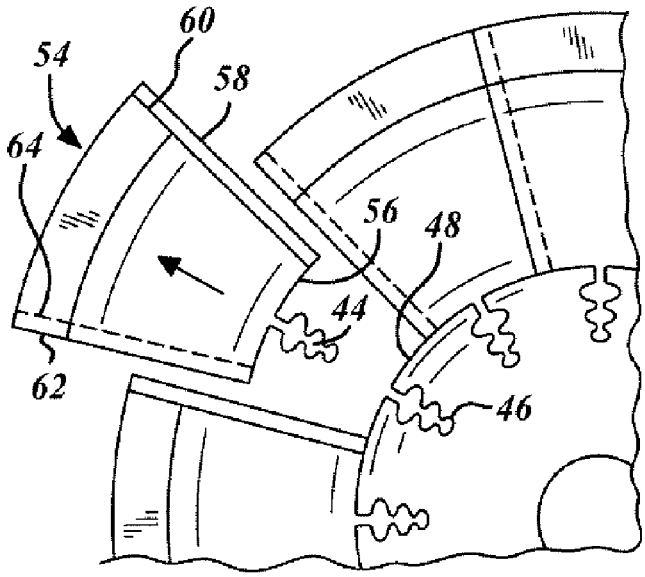
FIG. 4 is a detail illustration of an alternate embodiment of the x-ray tube target assembly shown in FIG. 2.
Figure 5:
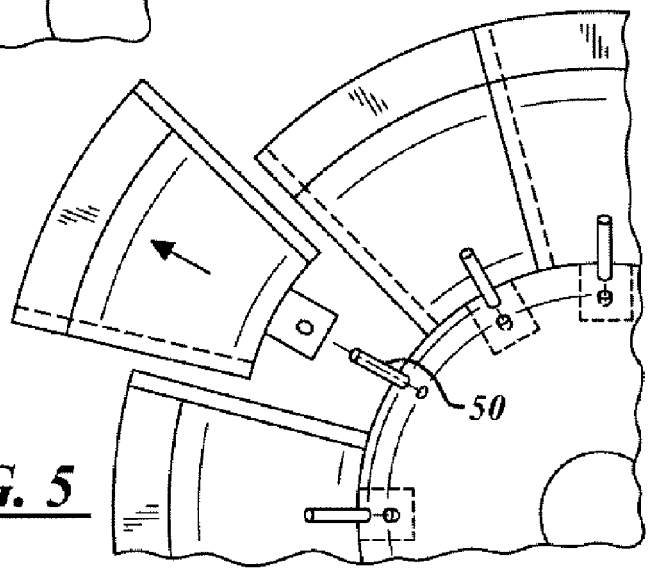
FIG. 5 is a detail illustration of an alternate embodiment of the x-ray tube target assembly shown in FIG. 2.
Figure 6:
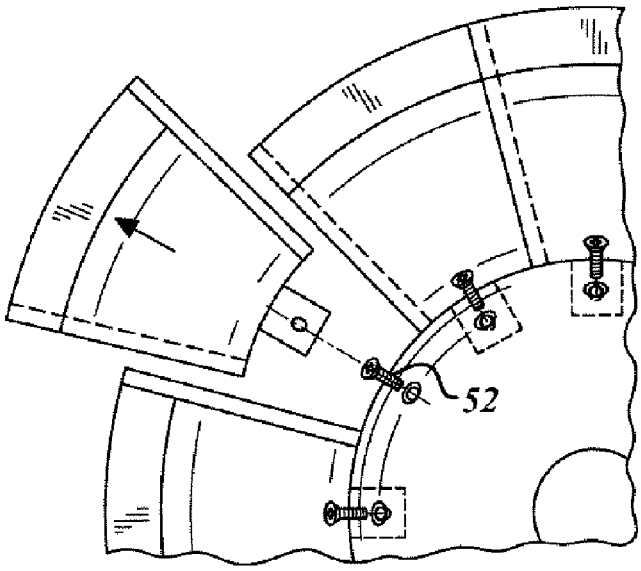
FIG. 6 is a detail illustration of an alternate embodiment of the x-ray tube target assembly shown in FIG. 2.

It is contemplated that the target assembly 24 may be formed in a variety of configurations such that the outer disc 28 is removably mounted to the center hub element 26. One such embodiment, illustrated in FIG. 3, contemplates the use of tab extensions 44 formed on the inner disc perimeter 38 and corresponding lock slots 46 formed on the outer hub perimeter 48. The tab extensions 44 sit within the lock slots 46 and secure the outer disc 28 to the hub element 26. Although lock slots 46 may be used, other methodologies are contemplated such as the use of pin elements 50 (see FIG. 5) or screw elements 52 (see FIG. 6). The present invention contemplates simplified manufacturing, assembly, and disassembly of the outer disc 28 from the hub element 26 to allow for cost effect manufacturing, part salvage, and repair and replacement. Although a variety of tab/slot combinations are contemplated, one embodiment contemplates the use of fir tree extensions and slots as illustrated in FIGS. 3 and 4.

While it is contemplated that the outer disc 28 may be formed as a single element, the advantages of inexpensive assembly, salvage, or repair provided by the present invention are further increased if the outer disc 28 is comprised of a plurality of partial circumferential disc portions 54. A tab extension 44 may be formed on the inner partial disc perimeter 56 of each partial circumferential disc portion 54. By forming the outer disc 28 from a plurality of partial disc portions, if a small segment of the target element 30 is damaged, only the partial circumferential disc portion 54 in question need by replaced or removed prior to salvage. This provides an unheralded level of reuse, maintenance, and cost effectiveness to x-ray tube targets.

Although the partial circumferential disc portions 54 may by assembled in a variety of fashions, one embodiment contemplates the use of side tabs 58 formed on a first radial side 60 of the partial circumferential disc portion 54. Opposing the side tab 58 on a second radial side 62 is formed a side slot 64. In this fashion, as seen in FIG. 4, each side tab 58 engages the side slot 64 of a neighboring partial circumferential disc portion 54 to form a solid outer disc 28. It is also preferred that each partial disc portion 54 have its own tab extension 44 to wed it to the hub periphery 48.

While particular embodiments of the invention have been shown and described, numerous variations and alternative embodiments will occur to those skilled in the art. Accordingly, it is intended that the invention be limited only in terms of the appended claims.

What is claimed is:

1. An x-ray target assembly comprising:

a center hub element affixed to a drive shaft;

an outer disc removably mounted to the outer periphery of the center hub element; and a target element mounted on an upper outer disc surface;

wherein said outer disc is in-line with and extends radially outwardly from the outer periphery of said center hub element;

wherein:

said outer disc comprises a plurality of tab extensions formed on an inner disc perimeter;

said center hub element comprises a plurality of lock slots formed in an outer hub perimeter; and each of said plurality of tab extensions is removably insertable into one of said plurality of lock slots to removably secure said outer disc to said center hub element.

2. An x-ray target assembly as described in claim 1, wherein said plurality of tab extensions comprise a plurality of fir-tree extensions.

3. An x-ray target assembly comprising:

a center hub element affixed to a drive shaft;

an outer disc removably mounted to the periphery of said center hub element; and a target element mounted on an upper outer disc surface;

wherein said outer disc comprises:

a plurality of partial circumferential disc portions removably assembled to form said outer disc.

4. An x-ray target assembly as described in claim 3, wherein each of said plurality of partial circumferential disc portions comprises:

a side tab formed on a first radial side of said partial circumferential disc portion; and a side slot formed on a second radial side of said partial circumferential disc portion;

wherein said side tab fits into said side slot on an adjacent one of said partial circumferential disc portions.

5. An x-ray target assembly as described in claim 3, wherein each of said plurality of partial circumferential disc portions comprises:

a tab extension formed on an inner partial disc perimeter;

said center hub element comprises a plurality of lock slots formed in an outer hub perimeter; and said tab extension removably insertable into one of said plurality of lock slots to removably secure said partial circumferential disc portion to said center hub element.

6. An x-ray target assembly comprising:

a center hub element affixed to a drive shaft;

an outer disc including a plurality of tab extensions removably engaging the outer periphery of said center hub element; and a target element mounted on an upper outer disc surface;

wherein said outer disc is in-line with and extends radially outwardly from the outer periphery of said center hub element.

7. An x-ray target assembly as described in claim 6, wherein each of said plurality of tab extensions is removably insertable into one of a plurality of lock slots formed in an outer perimeter of said center hub element, said tab extensions removably securing said outer disc to said center hub element.

8. An x-ray target assembly as described in claim 6, wherein said center hub element comprises a hub cross-sectional width;

wherein said outer disc comprises an inner disc cross-sectional width and an outer disc cross-sectional width; and wherein said inner disc cross-sectional width is smaller than said hub cross-sectional width.

9. An x-ray target assembly comprising:

a center hub element affixed to a drive shaft;

an outer disc including a plurality of tab extensions removably engaging the periphery of said center hub element; and a target element mounted on an upper outer disc surface;

wherein said outer disc comprises:

a plurality of partial circumferential disc portions assembled to form said outer disc.

10. An x-ray target assembly as described in claim 9, wherein each of said plurality of partial circumferential disc portions comprises:

a side tab formed on a first radial side of said partial circumferential disc portion; and a side slot formed on a second radial side of said partial circumferential disc portion;

wherein said side tab fits into said side slot on an adjacent one of said partial circumferential disc portions.

11. An x-ray target assembly as described in claim 9, wherein each of said plurality of partial circumferential disc portions comprises:

one of said plurality of tab extensions formed on an inner partial disc perimeter;

said tab extension removably insertable into a plurality of lock slots formed in said center hub to removably secure said partial circumferential disc portion to said center hub element.

12. A method of constructing an x-ray target assembly comprising:

manufacturing a center hub element affixed to a drive shaft;

manufacturing an outer disc including a plurality of tab extensions formed on an inner disc perimeter;

mounting a target element to an upper outer disc surface of said outer disc;

removably mounting said outer disc to the outer periphery of said center hub element by way of securing said tab extensions to said center hub element;

wherein said outer disc is in-line with and extends radially outwardly from the outer periphery of said center hub element.

13. A method as described in claim 12, further comprising:

exposing said target element to bombardment by electrons; and salvaging portions of the x-ray target assembly after extended use by removing said outer disc from said center hub element.

14. A method of constructing an x-ray target assembly comprising:

manufacturing a center hub element affixed to a drive shaft;

manufacturing an outer disc including a plurality of tab extensions formed on an inner disc perimeter;

mounting a target element to an upper outer disc surface of said outer disc;

removably mounting said outer disc to the periphery of said center hub element by way of securing said tab extensions to said center hub element;

manufacturing said outer disc as a plurality of partial circumferential disc portions; and assembling said partial circumferential disc portions to form said outer disc.

* * * * *